US007530142B2

(12) United States Patent
Sutterlütti et al.

(10) Patent No.: US 7,530,142 B2
(45) Date of Patent: May 12, 2009

(54) HINGE, IN PARTICULAR FOR CONNECTING TWO FLAP PORTIONS OF A FOLDING FLAP

(75) Inventors: Harald Sutterlütti, Fussach (AT); Helmut Fitz, Lustenau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/521,341

(22) Filed: Sep. 15, 2006

(65) Prior Publication Data

US 2007/0039972 A1 Feb. 22, 2007

Related U.S. Application Data

(63) Continuation of application No. PCT/AT2005/000024, filed on Jan. 27, 2005.

(30) Foreign Application Priority Data

Mar. 16, 2004 (AT) ..... GM197/2004

(51) Int. Cl.
*E05D 7/04* (2006.01)

(52) U.S. Cl. ..... 16/242; 16/239; 16/362

(58) Field of Classification Search ..... 16/242, 16/240, 245, 258, 249, 286, 284, 289, 239 X, 16/357, 358, 360, 362–364, 371
See application file for complete search history.

(56) References Cited

U.S. PATENT DOCUMENTS 1,091,233 A * 3/1914 Mitchell ..... 16/239
1,490,956 A * 4/1924 Binder ..... 16/239
2,883,699 A 4/1959 Gross
3,978,549 A * 9/1976 Vitt ..... 16/245
4,091,501 A * 5/1978 Lautenschlager et al. ..... 16/357
4,236,272 A * 12/1980 Gronbach et al. ..... 16/288
4,411,046 A * 10/1983 Nawrath ..... 16/354
5,511,287 A * 4/1996 Lautenschlager et al. ..... 16/239
5,535,482 A * 7/1996 Grabber ..... 16/286

FOREIGN PATENT DOCUMENTS

EP 0 955 436 11/1999
EP 1 270 858 1/2003
EP 1505238 A2 * 2/2005
ES 2 192 971 10/2003
FR 2 571 417 4/1986

* cited by examiner

*Primary Examiner*—Chuck Y. Mah
(74) *Attorney, Agent, or Firm*—Wenderoth, Lind & Ponack, L.L.P.

(57) ABSTRACT

A hinge is provided for connecting two flap portions of a folding flap, and there is a gap between the flap portions. The hinge includes two hinge portions, each of which can be fixed to a flap portion. At least one of the hinge portions which is mounted displaceably with respect to a mounting plate is held in a first position by a force-exerting holding device and is movable into a second position after the force is overcome and the holding device is released or unlatched, with the gap between the flap portions being increased.

25 Claims, 8 Drawing Sheets

HINGE, IN PARTICULAR FOR CONNECTING TWO FLAP PORTIONS OF A FOLDING FLAP

This application is a continuation of International application No. PCT/AT2005/000024, filed Jan. 27, 2005.

BACKGROUND OF THE INVENTION

The invention relates to a hinge, in particular for connecting two flap portions of a folding flap, comprising two hinge portions. Each of the hinge portions can be fixed to a flap portion, and there is a gap between the flap portions.

The object of the invention is to improve such a hinge to the effect that a finger is prevented from being jammed between the door portions when a folding flap is closed.

SUMMARY OF THE INVENTION

The object according to the invention is attained in that at least one of the hinge portions which is mounted displaceably with respect to a mounting plate is held in a first position by a force-exerting holding device and is movable into a second position after the force is overcome, with the gap between the flap portions being increased.

Preferably there are three variants in terms of displaceability of the hinge portion. Thus, on the one hand, the mounting plate is adapted to connect the displaceably mounted hinge portion (referred to for brevity as the displaceable hinge portion) to one of the flap portions, in which case the displaceable hinge portion is mounted displaceably relative to that mounting plate. On the other hand, it is also possible for the displaceable hinge portion to be fixable to one of the flap portions, optionally by means of a mounting plate, and to be mounted displaceably relative to a mounting plate of the second hinge portion. The third variant which presents itself is for the first-mentioned possibilities to be combined together. The last-mentioned possibility can then be particularly desirably used when the gap between the flap portions is to be enlargeable by a particularly great amount.

All variants according to the invention have the advantage that the gap can be embodied by means of one or more, preferably linear, displacement movement or movements along one or more guide paths without the hinge for that purpose having to permit structurally complicated and expensive, additional pivotal or folding movements.

It is advantageously provided that the displaceable hinge portion is acted upon by at least one spring.

In a further embodiment of the invention, supported in the displaceable hinge portion is a spring-loaded latching projection which latches into a recess in the mounting plate.

In a further embodiment, the holding device is formed by a magnet.

BRIEF DESCRIPTION OF THE DRAWINGS

Various embodiments by way of example of the invention are described hereinafter with reference to the Figures of the accompanying drawings in which.

DETAILED DESCRIPTION OF THE INVENTION

Figure 2:
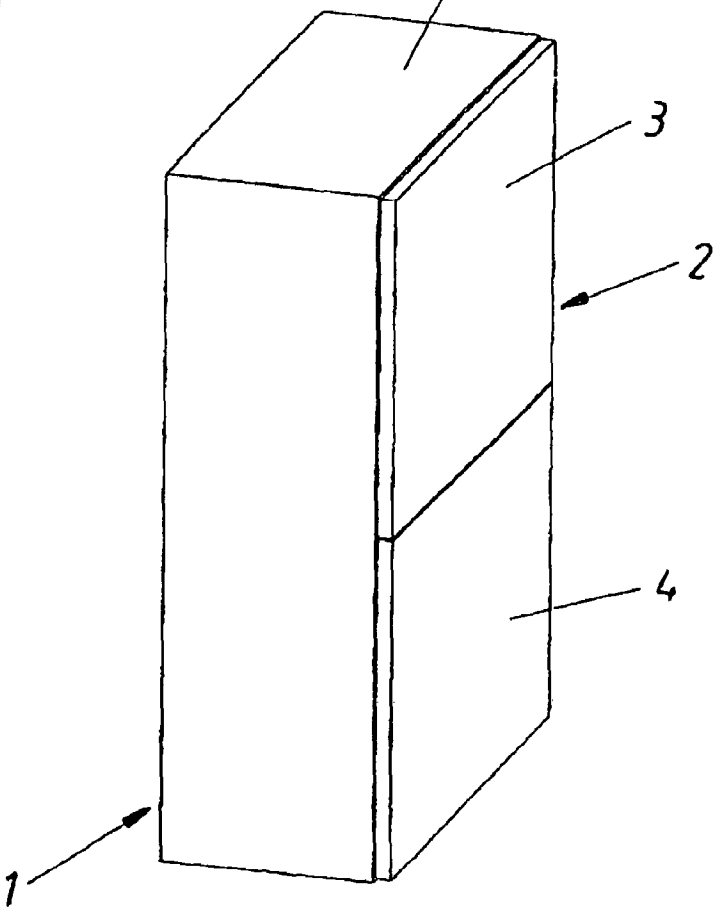
FIG. 2 is a perspective view of an article of furniture with a closed folding flap.
Figure 1:
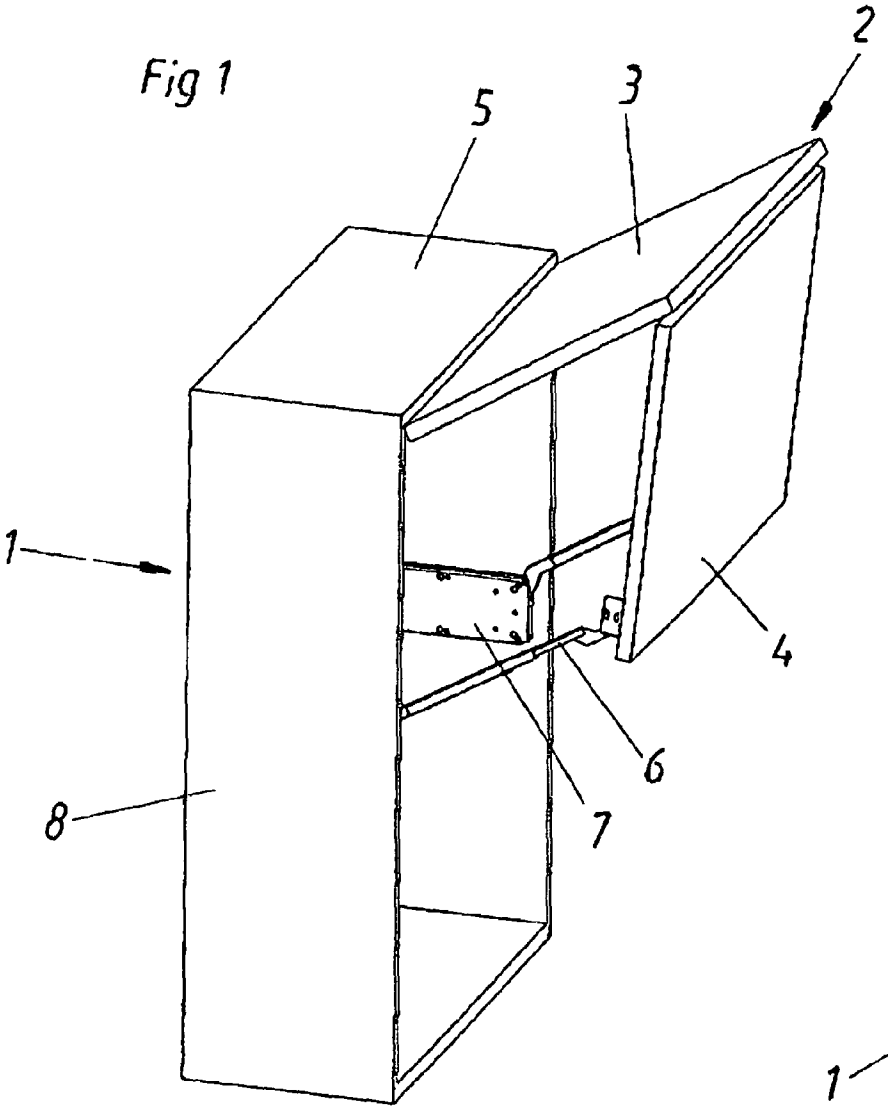
FIG. 1 is a perspective view of an article of furniture with an opened folding flap.
Figure 3:
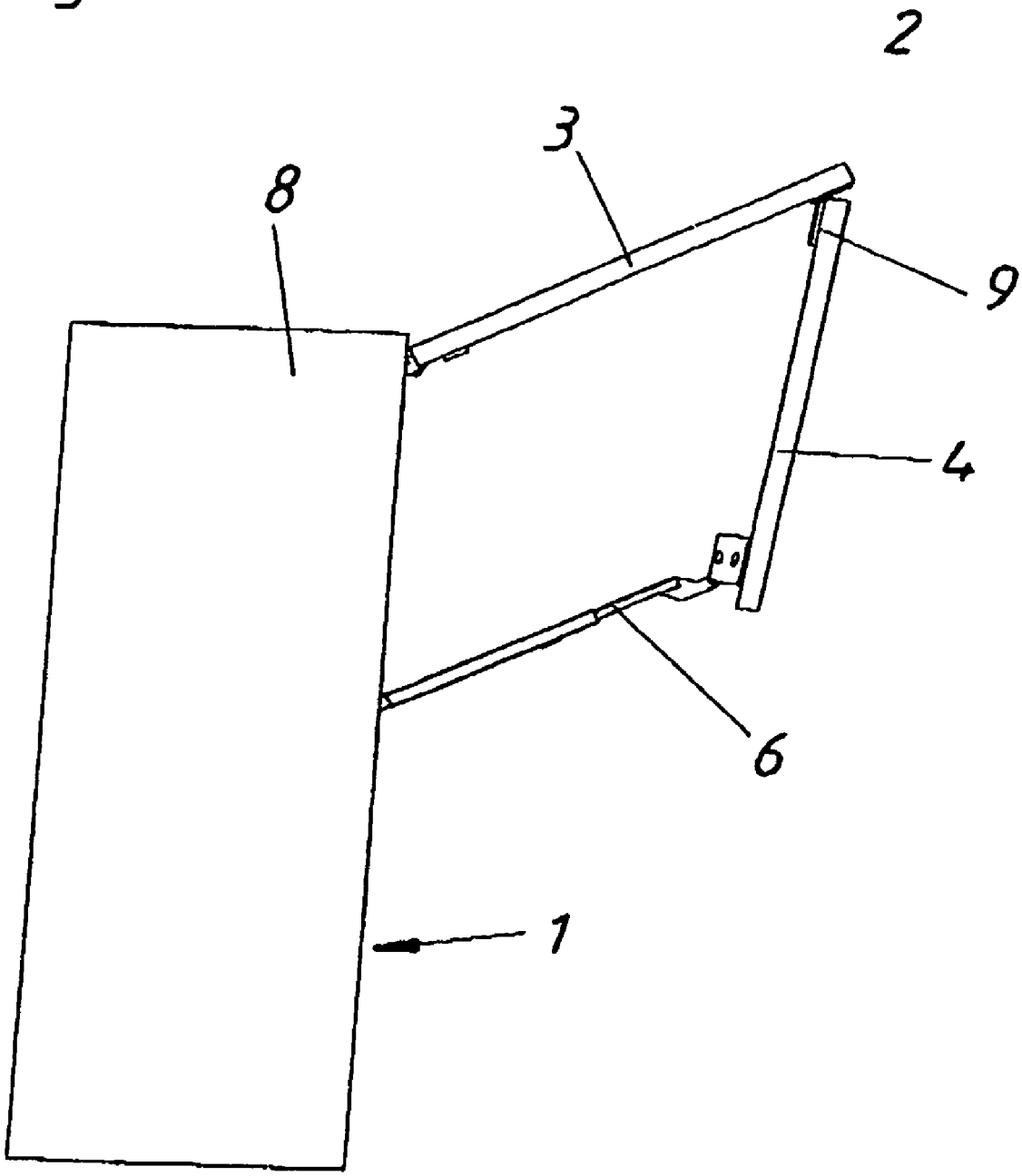
FIG. 3 is a side view of an article of furniture with an opened folding flap.
Figure 4A:
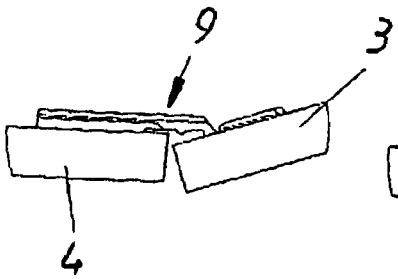
FIGS. 4*a*-4*c* are side views of a first hinge according to the invention and parts of the flap portions, wherein the flap portions are shown in a normal closing and opening process.
Figure 4B:
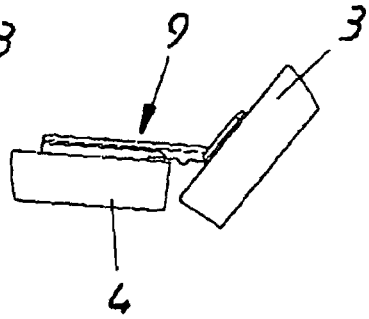
Figure 4C:
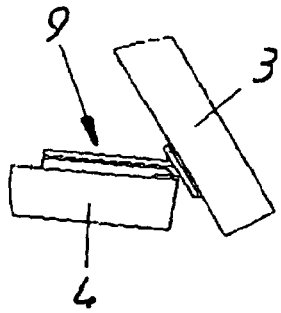

FIGS. 1 through 3 each show a cupboard comprising the body 1 of the article of furniture, which is covered by a folding flap 2. The folding flap 2 comprises two (first and second) flap portions 3, 4. The upper (first) flap portion 3 is fixed to the upper end panel 5 of the body 1 of the article of furniture by hinges while the lower flap portion 4 is fixed to the upper flap portion 3. Near its lower edge, the lower flap portion 4 is pivotably connected to control arms 6 of furniture plates 7 which are mounted to the side walls 8 of the article of furniture. In the illustrated embodiment, the flap portions 3, 4 are connected together by hinges 9.

In the illustrated variants, the hinges 9 are in the form of single-axis hinges and in a conventional manner comprise a hinge portion 10 in the form of a hinge arm and a hinge portion 11 in the form of a hinge cup. In the illustrated embodiment, the cup-like first hinge portion 11 is fitted into the flap portion 3 and the arm-like second hinge portion 10 is mounted to the flap portion 4 by a mounting plate 12. The reverse arrangement would be equally well possible.

Figure 6:
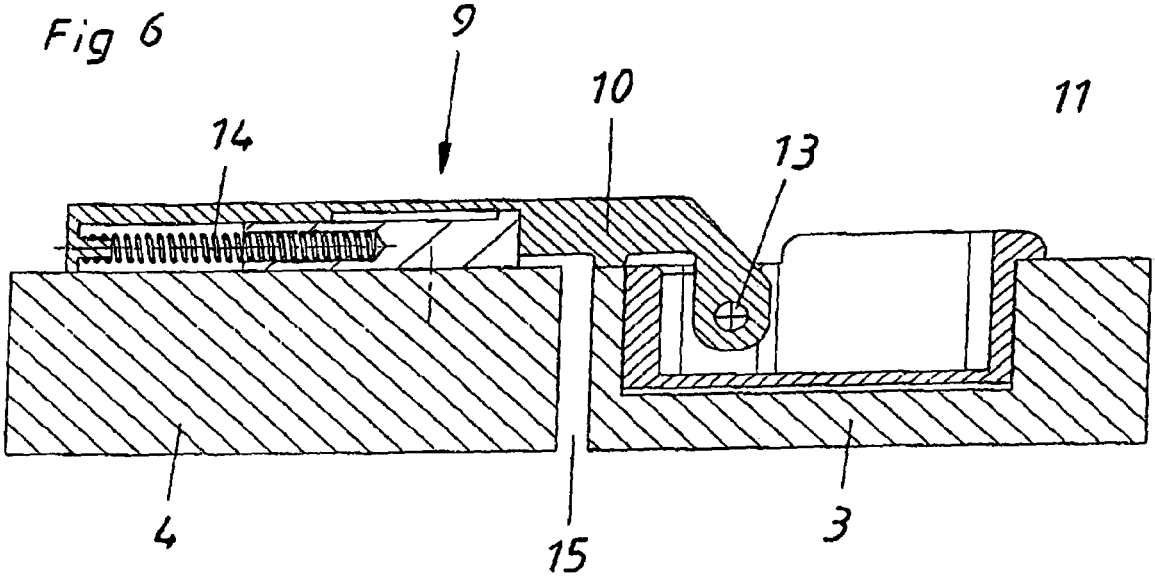
FIG. 6 is a view in section through a hinge according to the invention and regions of the flap portions, with the hinge being shown in the closed position.
Figure 8:
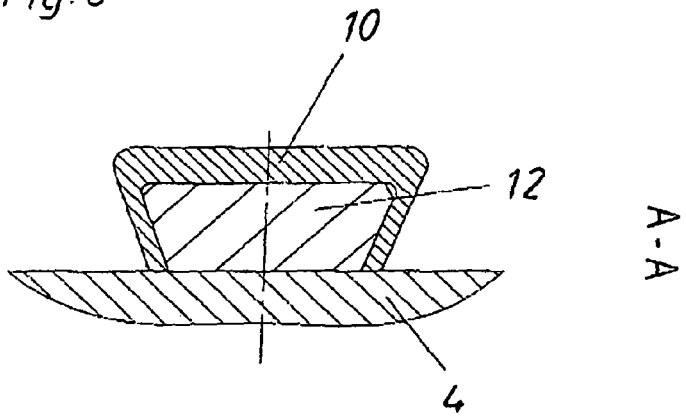
FIG. 8 is a view in section taken along line A-A in FIG. 7.
Figure 7:
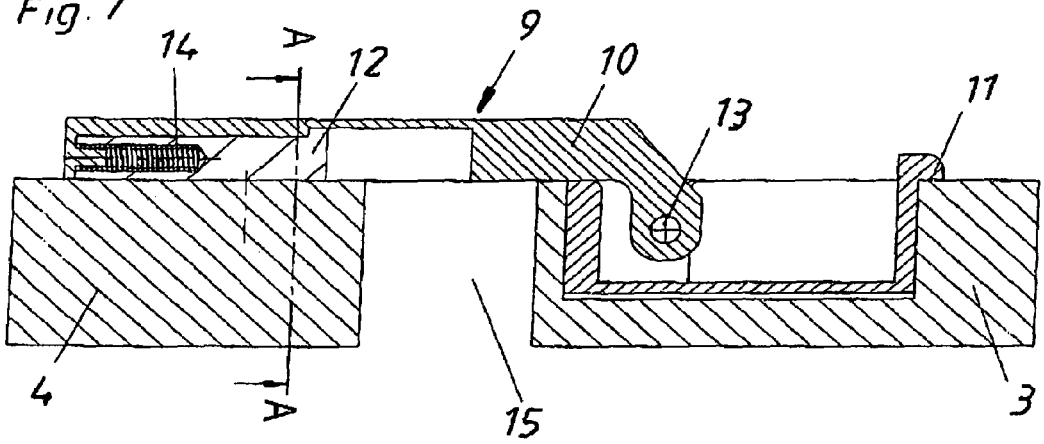
FIG. 7 is a view in section through a hinge and regions of the flap portions, with the hinge being shown in the position in which the finger safeguard effect is operative.
Figure 5A:
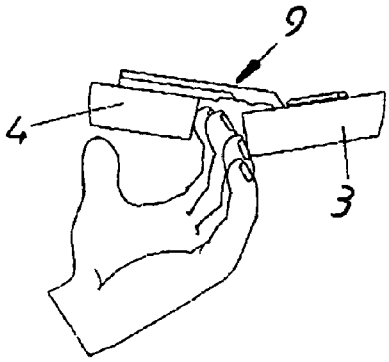
FIGS. 5*a*-5*c* are side views of the hinge and parts of the flap portions, illustrating the finger safeguard effect.
Figure 5B:
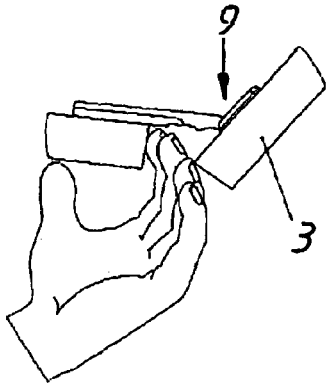
Figure 5C:
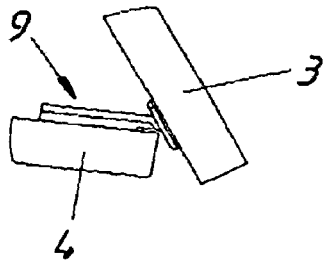

The second hinge portion 10 is mounted displaceably on the mounting plate 12, more specifically in perpendicular relationship to the hinge axis 13. In the embodiment shown in FIGS. 6 and 7, a spring 14 is mounted in the hinge portion 10 and forms the force-exerting holding device. The spring 14 is supported against the mounting plate 12 and acts on the hinge portion 10 in such a way that the two flap portions 3, 4, when the folding flap 2 is in a closed condition, assume their normal position In other words, a gap 15 between the two flap portions 3, 4 is relatively narrow.

Upon closure of the folding flap 2, if anyone should put his finger into the gap 15 between the two flap portions 3, 4, the spring 14 then yields and the flap portion 4 is pushed away from the flap portion 3. Thus, is to say the gap 15 is increased in size and the finger is prevented from being painfully clamped. As soon as the gap 15 is cleared again, the spring 14 urges the hinge arm 10 rearwardly again and displaces the flap portion 4 with respect to the flap portion 3.

Figure 10:
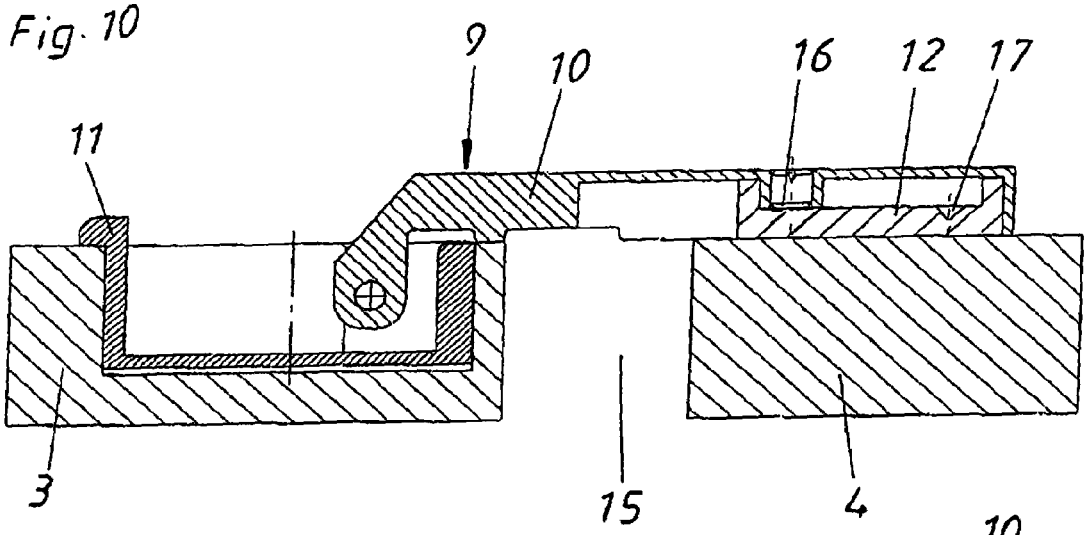
FIG. 10 is a view in section through a hinge of the embodiment of FIG. 8, with the finger safeguard effect being operative.
Figure 9:
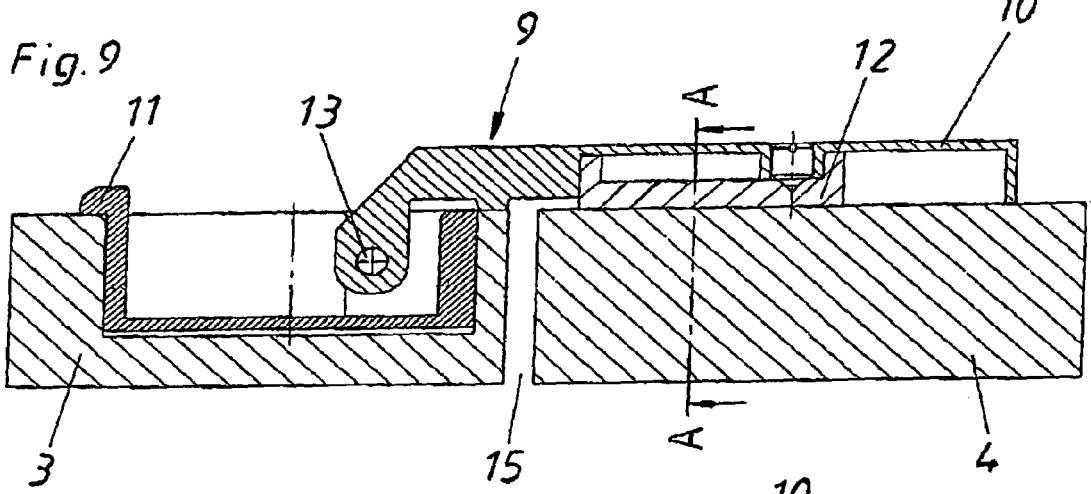
FIG. 9 is a view in section through a further embodiment of a hinge which is illustrated in the closed position.
Figure 11:
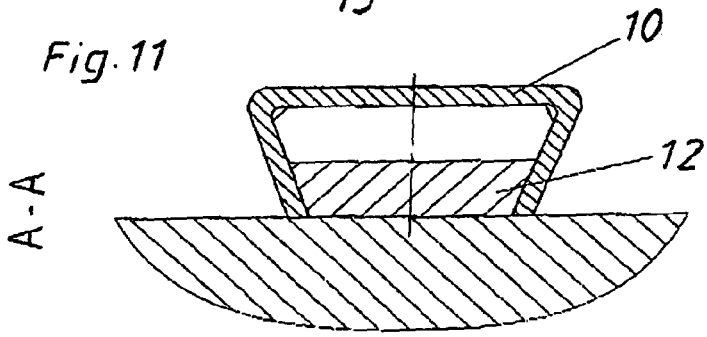
FIG. 11 is a view in section taken along line A-A in FIG. 9, FIGS. 12 and 13 are sectional views of an embodiment by way of example of the invention, in which the hinge portions are mounted displaceably relative to each other.

In the embodiment shown in FIGS. 9 and 10, the hinge arm-like hinge portion 10 is provided with a spring-loaded latching projection 16 which in the normal position of the flap portions 3, 4 latches in a recess 17 in the mounting plate 12. The latching projection 16 forms the force-exerting holding device (i.e., a spring-loaded holding device).

If a user of the cupboard should put one or more fingers in the gap 15 when closing the folding flap 2 and thereby generate a force sufficient to overcome the spring locking force of holding device 16, then the spring-loaded projection 16 comes out of latching engagement with the recess 17 and the hinge portion 10 is displaceable on (moves with respect to) the mounting plate 12 so that the gap 15 becomes sufficiently wide so as not to clamp the finger or fingers. The flap portion 4 with the mounting plate 12 then has to be pushed back into the position shown in FIG. 9 again, whereupon the spring-loaded projection 16 comes into latching engagement again.

Instead of the spring-loaded projection 16 the force-exerting holding device can also be in the form of a magnet if the mounting plate 12 and/or the hinge portion 10 are made from magnetisable material.

Figure 12:
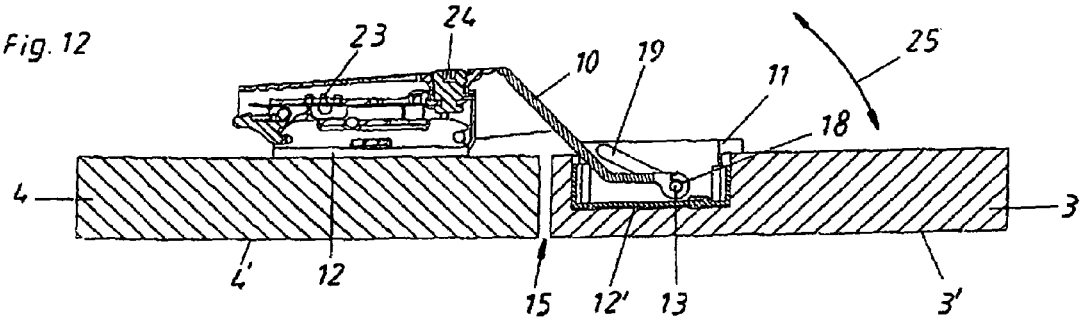
Figure 13:
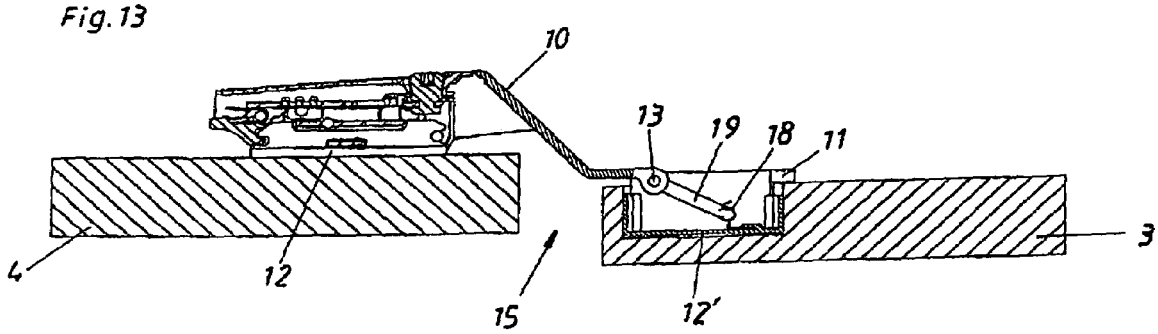

In the embodiments shown in FIGS. 1 through 11, the displaceable hinge portion 10 is always mounted displaceably relative to a mounting plate 12 with which it can also be fixed to the flap portion 4. A possible alternative thereto will be described by means of the embodiment with reference to FIGS. 12 through 14. Here the displaceable hinge portion 10 is fixed on the flap portion 4 by way of a mounting plate 12. It is mounted displaceably with respect to a mounting plate 12' of the second hinge portion 11. In the illustrated embodiment, it is in the form of a hinge cup while the displaceable hinge portion 10 is in the form of a hinge arm. FIG. 12 shows the normal position in which the hinge arm 10 is held with the hinge axis 13 by the latching spring 18 or is latched thereinto. In that case, the latching spring 18 forms the force-exerting holding device which is arranged in the second hinge portion 11. FIG. 13 shows the position in which the gap 15 is enlarged to its maximum extent. That position is reached when an object such as, for example, a finger passes into the gap 15 when closing the flap portions 3 and 4 and the holding force of the latching spring 18 is overcome thereby. After the force is overcome, the pivot axis 13, by means of which the two hinge portions 10 and 11 are pivotably connected together, can be moved into the second position shown in FIG. 13. The movement takes place along a guide path 19 which is arranged in the second hinge portion 11 and which can preferably be in the form of a guide groove. The guide path 19 is substantially straight and extends inclinedly relative to the mounting plate 12' of the second hinge portion 11 in the illustrated embodiment. In the illustrated embodiment, the hinge axis 13 is rigidly arranged on or connected to the displaceable hinge portion 10.

Once the finger safeguard embodied in that way has been triggered and when the hinge is in the position shown in FIG. 13, it is then sufficient for the two flap portions 3 and 4 to be pushed together so that the axis 13 slides along the guide path 19 in the direction of the latching spring 18 and latches thereinto once again, thereby re-establishing the starting condition shown in FIG. 12. The pivotal movements of the flap portions 3 and 4 about the hinge axis 13, which are to be implemented in normal operation when opening and closing the flap portion, are indicated by a double-headed arrow 25 in FIG. 12.

In addition, for the purposes of adjusting the two flap portions 3 and 4 in the closed condition of the folding flap as shown in FIG. 12, there can also be adjusting devices 23 and 24. The device 23 can be of a configuration like a depth adjusting device which is known from other hinges and can be used for setting the width of opening of the gap 15 in the position shown in FIG. 12. The device 24 can be of a configuration similar to gap adjusting screws which are known per se in relation to hinges, and can serve to align the fronts 3' and 4' of the flap portions 3 and 4 in such a way that, in the closed position shown in FIG. 12, they are arranged in a common plane.

Figure 14:
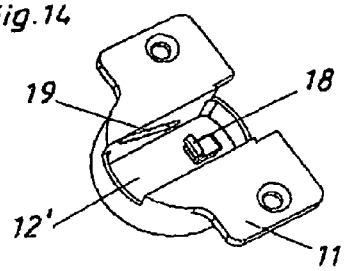
FIG. 14 is a perspective view of the second hinge portion, which is in the form of a hinge cup, of the embodiment of FIGS. 12 and 13, and FIGS. 15-18 are views of a further embodiment according to the invention in which the displaceable hinge portion is mounted displaceably relative to two mounting plates, as sectional views.
Figure 15:
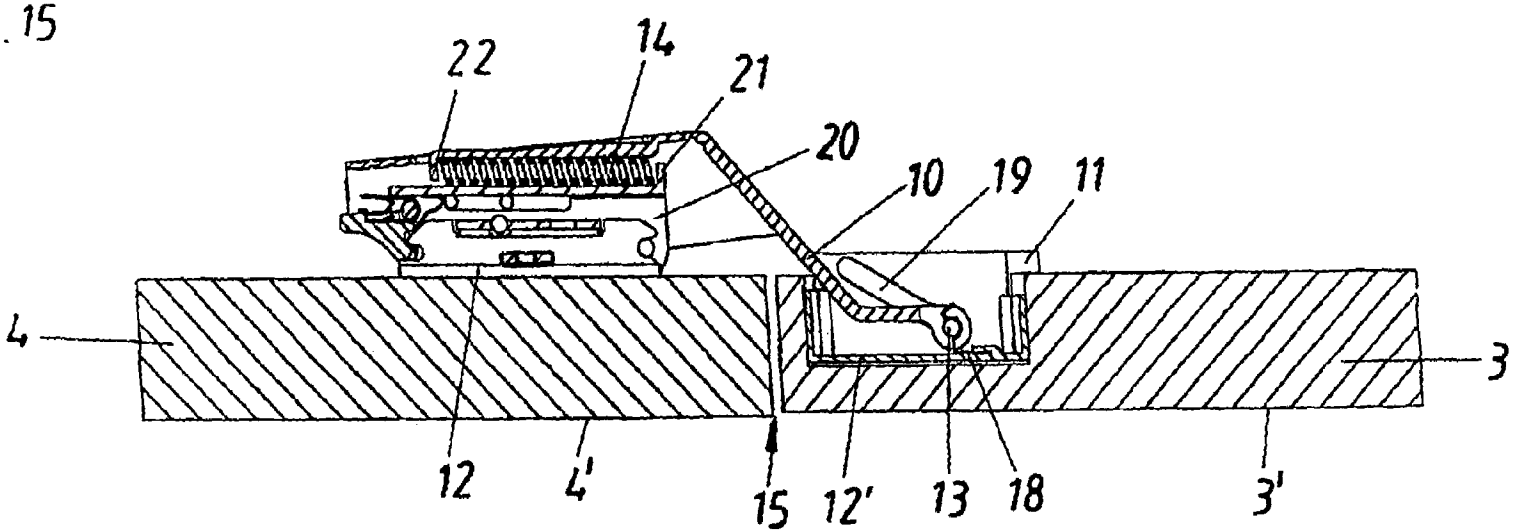

FIG. 14 shows a perspective view of the second hinge portion 11 which is in the form of a hinge cup and the latching spring 18 which is arranged on the mounting plate 12' of the second hinge portion 11.

Figure 16:
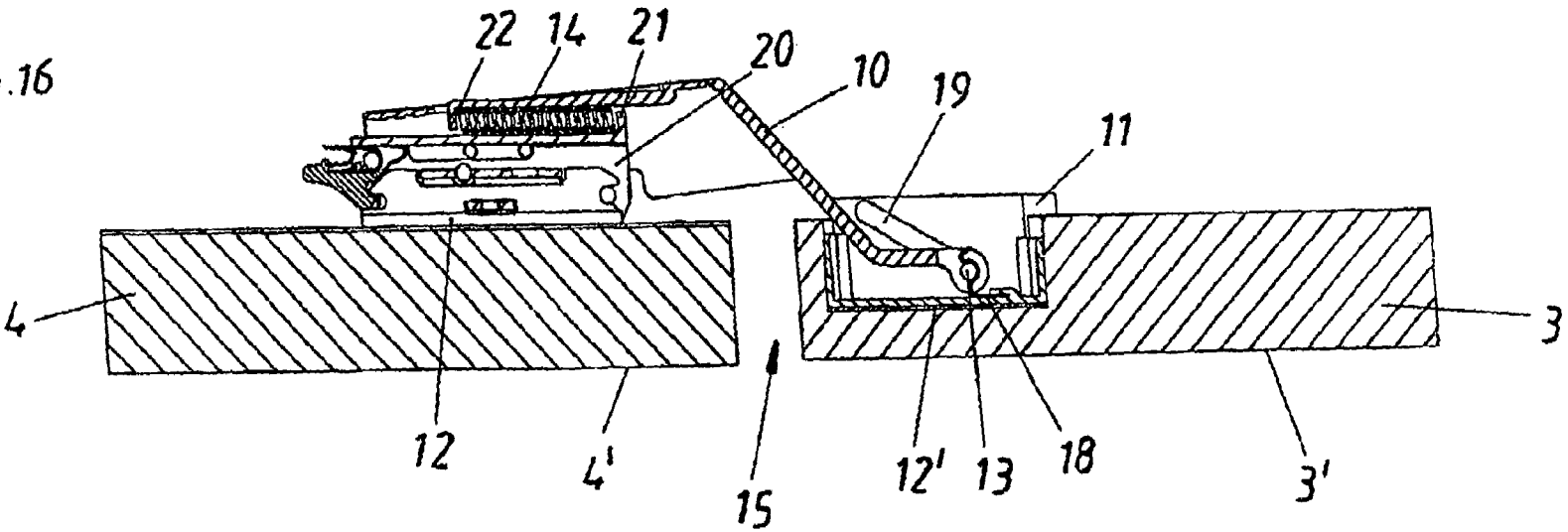
Figure 17:
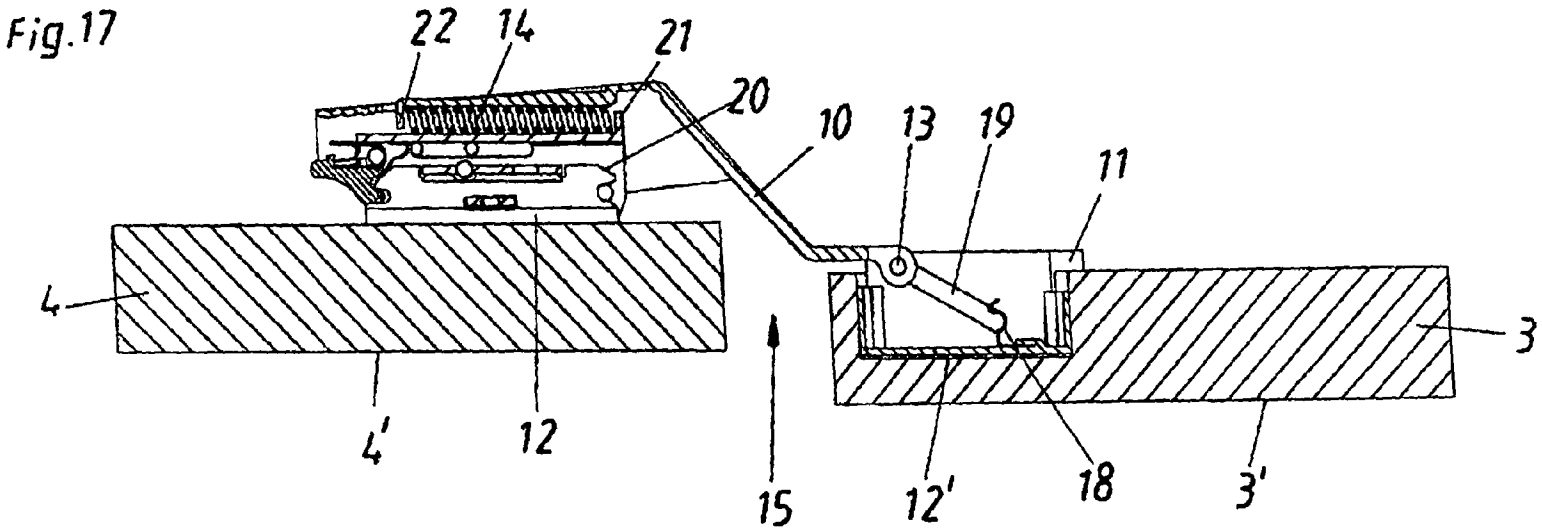
Figure 18:
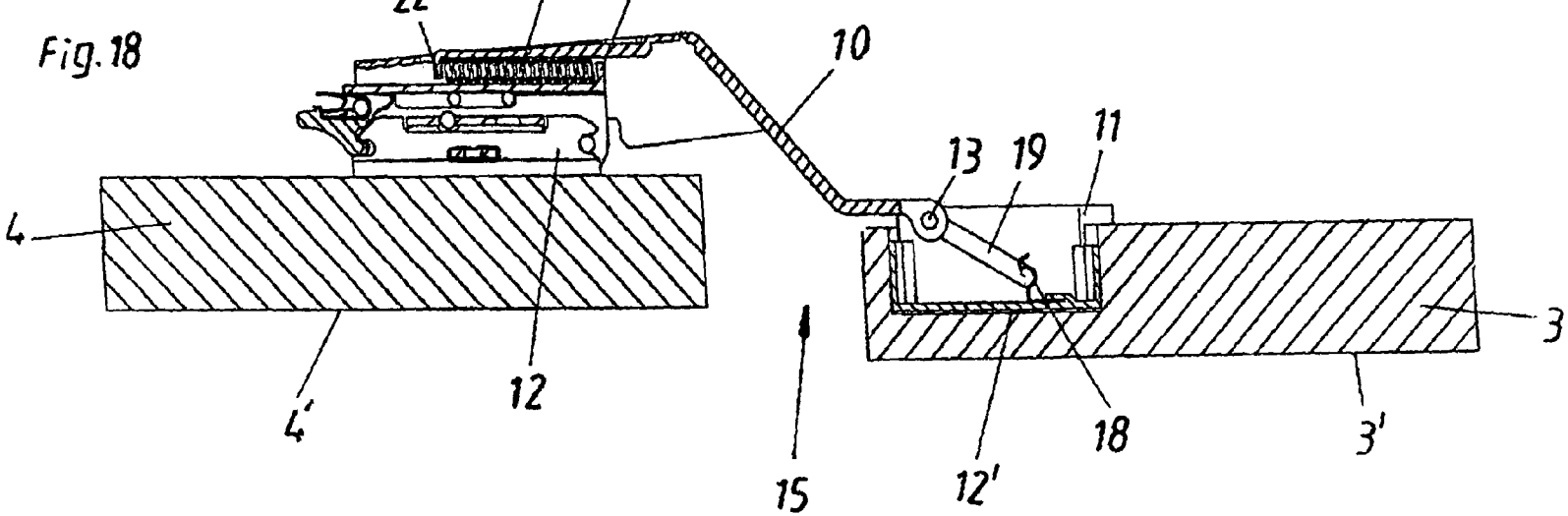

The embodiment of FIGS. 15 through 18 shows a variant in which the displaceable hinge portion 10 is mounted displaceably both relative to a mounting plate 12 with which it can be fixed to the one flap portion 4, and also relative to the second hinge portion 11 which is fixed to the other flap portion 3, or the mounting plate 12' thereof. The displaceable mounting of the hinge portion 10 which is in the form of a hinge arm, on the mounting plate 12, can basically be of various different configurations. Thus, inter alia, all the variants shown in FIGS. 6 through 11 are possible. FIGS. 15 through 18 show a variant in which a spring 14 is arranged between the displaceably mounted hinge portion 10 and an intermediate portion 20 which can be clipped on to the mounting plate 12. In this case the spring 14 is supported against a holding projection 21 of the intermediate portion 20 and a holding projection 22 of the hinge portion 10. FIG. 16 shows a position in which the gap is increased by displacement of the hinge portion 10 relative to the mounting plate 12 or the intermediate portion 20 arranged thereon, with simultaneous compression of the spring 14. In order to be able to still further increase the size of the gap 15, the displaceable hinge portion 10 is also additionally mounted displaceably relative to the second hinge portion 11 or the mounting plate 12' thereof. That additional displaceability is implemented as in the embodiment shown in FIGS. 12 through 14. FIG. 17 shows an intermediate position in which the gap 15 has been enlarged solely by displacement of the hinge axis 13 along the guide path 19. FIG. 18 shows the position with maximum enlargement of the gap. That results from a combination of the intermediate positions shown in FIGS. 16 and 17. The width of opening of the gap 15 corresponds in FIG. 18 to the total of the widths of opening in FIGS. 16 and 17.

It will be clear to the man skilled in the art from the large number of various explicitly described alternative configurations that the invention is not restricted thereto. The various features of the alternative configurations can be combined together as desired, which in each case leads to new configurations. Thus, it is in particular possible for the latching spring 18 of the second hinge portion 11 to be replaced by a spring which acts over the entire adjustment travel, similarly to the spring 14. In addition, it is also possible for example for two hinge arms or hinge cups which are designed in accordance with the respective specific embodiments to be connected together by way of a hinge axis. That would then result in hinges of a symmetrical configuration. In particular, above all, the notion of a mounting plate is to be interpreted broadly as the illustrated specific embodiments clearly show.

The invention claimed is:

1. A hinge for connecting two flap portions, comprising:

a first hinge portion to be fixed to a first one of the flap portions;

a second hinge portion to be fixed to a second one of the flap portions via a mounting plate, said second hinge portion being mounted to said mounting plate so as to be moveable relative to said mounting plate; and a spring-loaded holding device operable to lock and hold said second hinge portion to said mounting plate with a spring locking force such that said second hinge portion is located in a first position, said first hinge portion, said second hinge portion, and said mounting plate being arranged such that a first-sized gap is defined between the first one of the flap portions and the second one of the flap portions when said second hinge portion is located in said first position;

wherein said spring-loaded holding device is operable to unlock and release said second hinge portion from said mounting plate when a force greater than said spring locking force is applied between said first hinge portion and said second hinge portion, said second hinge portion being operable to move relative to said mounting plate to a second position after said spring-loaded holding device unlocks and releases said second hinge portion, said first hinge portion, said second hinge portion, and said mounting plate being arranged such that a second-sized gap is defined between the first one of the flap portions and the second one of the flap portions when said second hinge portion is located in said second position, said second-sized gap being larger than said first-sized gap.

2. The hinge of claim 1, wherein said spring-loaded holding device includes at least one spring for producing said spring locking force to lock and hold said second hinge portion.

3. The hinge of claim 2, wherein said at least one spring comprises a coil spring oriented perpendicularly with respect to said first-sized gap and said second-sized gap between the flap portions.

4. The hinge of claim 1, wherein said mounting plate has projections for holding said second hinge portion.

5. The hinge of claim 1, wherein said spring-loaded holding device comprises a spring-loaded latching projection supported in said second hinge portion, said spring-loaded latching projection being shaped and arranged to latch into a recess in said mounting plate.

6. The hinge of claim 1, wherein said second hinge portion is formed as an elongated arm.

7. The hinge of claim 6, wherein said first hinge portion has a cup-shaped configuration, and has an axis on which said second hinge portion is pivotably mounted.

8. The hinge of claim 1, wherein said second hinge portion comprises a hinge arm.

9. The hinge of claim 1, wherein said second hinge portion is mounted so as to be moveable relative to a mounting plate of said first hinge portion.

10. The hinge of claim 9, wherein said second hinge portion comprises a hinge arm.

11. The hinge of claim 9, wherein said first hinge portion comprises a hinge cup.

12. The hinge of claim 9, wherein said second hinge portion and said first hinge portion are pivotably connected together by a hinge axis.

13. The hinge of claim 12, wherein said hinge axis is mounted so as to be moveable along a guide path arranged in said second hinge portion, said hinge axis being moveable relative to said second hinge portion.

14. The hinge of claim 13, wherein said guide path extends at an incline relative to said mounting plate of said second hinge portion.

15. The hinge of claim 13, wherein said guide path is substantially straight.

16. The hinge of claim 12, wherein said hinge axis is rigidly connected to said second hinge portion.

17. The hinge of claim 12, wherein said spring-loaded holding device comprises a latching spring in said second hinge portion, said latching spring being shaped and arranged to latch to and unlatch from said hinge axis.

18. The hinge of claim 17, wherein said latching spring is arranged at said mounting plate of said second hinge portion.

19. The hinge of claim 17, wherein said second hinge portion comprises a hinge arm.

20. The hinge of claim 1, wherein said mounting plate comprises a first mounting plate, further comprising a second mounting plate for fixing said first hinge portion to the first one of the flap portions, said second hinge portion being mounted to said first mounting plate so as to be moveable relative to said second mounting plate.

21. The hinge of claim 20, wherein said first hinge portion comprises a hinge cup.

22. The hinge of claim 1, wherein said mounting plate has a recess formed therein, said spring-loaded holding device comprising a spring-loaded projection arranged to extend into said recess to lock and hold said second hinge portion to said mounting plate when said second hinge portion is located in said first position.

23. The hinge of claim 22, wherein said second hinge portion comprises an elongated hinge arm, said first hinge portion comprises a hinge cup pivotably connected to an end of said hinge arm.

24. The hinge of claim 23, wherein said spring-loaded projection is mounted to said hinge arm.

25. The hinge of claim 1, wherein said spring-loaded holding device comprises a spring-loaded first latching member connected to one of said second hinge portion and said mounting plate, said spring-loaded first latching member being shaped and arranged to engage and lock onto a second latching member on the other of said second hinge portion and said mounting plate, and to unlock and release said second latching member when the force greater than said spring locking force is applied between said first hinge portion and said second hinge portion.

* * * * *